US006254256B1

(12) United States Patent
Wolfe

(10) Patent No.: US 6,254,256 B1
(45) Date of Patent: Jul. 3, 2001

(54) LIGHT-SCATTERING REFLECTOR

(75) Inventor: Denis Wolfe, San Leandro, CA (US)

(73) Assignee: Prescolite, Inc., San Leandro, CA (US)

( * ) Notice: Subject to any disclaimer, the term of this patent is extended or adjusted under 35 U.S.C. 154(b) by 0 days.

(21) Appl. No.: 09/307,326

(22) Filed: May 7, 1999

(51) Int. Cl.[7] ..... F21V 7/00
(52) U.S. Cl. ..... 362/348; 362/350; 72/82
(58) Field of Search ..... 362/296, 347, 362/348, 350; 72/82, 83

(56) References Cited

U.S. PATENT DOCUMENTS

| | | | | |
|---|---|---|---|---|
| 1,744,907 | * | 1/1930 | Luce | 72/82 |
| 4,117,704 | | 10/1978 | Nakache et al. . | |
| 4,321,105 | | 3/1982 | Melonio et al. . | |
| 4,408,472 | | 10/1983 | Azarevich et al. . | |
| 4,953,376 | | 9/1990 | Merlone . | |
| 5,014,175 | * | 5/1991 | Osteen et al. | 362/348 |
| 5,220,817 | | 6/1993 | Wenzel et al. . | |
| 5,465,598 | | 11/1995 | Hirai et al. . | |
| 5,640,867 | | 6/1997 | Massée . | |
| 5,775,151 | | 7/1998 | Massée . | |

* cited by examiner

*Primary Examiner*—Stephen Husar
(74) *Attorney, Agent, or Firm*—Theodore J. Bielen, Jr.

(57) ABSTRACT

A reflector for an illumination source manufactured by a spin chuck having an edge surface. The reflector includes a body having a contiguous portion composed of an endless outer surface and a reflective endless inner surface. The body further includes an opening communicating with the endless inner surface. The endless inner surface possesses a relatively fine pattern of depressions and protuberances derived from an edged surface of the spin chuck. The edge surface permits release of the body from the spin chuck although the body may be formed into a rounded or curved member.

17 Claims, 2 Drawing Sheets

LIGHT-SCATTERING REFLECTOR

BACKGROUND OF THE INVENTION

The present invention relates to a novel and useful light-scattering reflector and process for manufacturing the same.

Spin chucks are employed to form products which generally possess a unitary configuration, typically with a cavity. In general, the product is formed on a chuck by rotating the chuck about an axis and moving a roller or multiplicity of rollers one or more times along a sheet of material to pressure the sheet against the chuck. In this manner, the sheet, which may be metallic, conforms to the configuration of the chuck to produce the article.

For example, U.S. Pat. Nos. 4,117,704; 4,408,472; 4,953,376; 5,220,817; and 5,775,151 describe methods and apparatuses for using a spin chuck-type method to form articles.

U.S. Pat. No. 5,465,598 describes a method for forming an annular member by rotating a convex dye.

U.S. Pat. No. 5,640,867 shows a method and apparatus for forming a rim on a lamp reflector employing a roller which is also used to form the annular body on a spin chuck.

Lamp reflectors are often curvilinear in cross-sectional configuration. That is to say, reflectors for lamps may take forms other than right circular cylinders. In most cases, the inner surface of an annular lamp reflector is specular, reflecting or diffusing light from a lamp located at or near the inner chamber of the reflector. It has been found that it is highly desirable to alter the reflecting surface, normally the inner surface, of an annular reflector to achieve light scattering, which sometimes is referred to as "glow". To accomplish this task, prior reflectors are normally formed on a spin chuck or by other methods followed by alteration of the inner surface of the reflector to create uneven surface texture. For example, the inner surface of lamp reflectors have been sandblasted or peened to produce roughness or bumps, respectively. Unfortunately, these method have produced a very bright type of reflection, which has been deemed to be undesirable. In addition, the inner surfaces of lamp reflectors formed on spin chucks have been subsequently chemically etched with an acid or base solution. However, the reflection, again, is very bright and, thus, undesirable. It has been proposed that the spin chuck itself be peened or sandblasted however prior attempts by others have resulted in lamp reflectors that become fixed to the spin chuck following formation by a roller through the spin chuck method. Such manufacturing problems are particularly vexing with curved reflectors.

Molding of reflectors from plastic-like material have met with the same problems in that textures on the mold prevent removal of the plastic reflectors from mold, rendering such processes as inoperable.

A reflector formed from a spin chuck method which possesses a reflecting inner surface capable of scattering or producing diffuse light would be a notable advance in the lighting industry.

BRIEF SUMMARY OF THE INVENTION

The present invention relates to a novel and useful reflector possessing light scattering capabilities, as well as a method of producing the same.

The reflector of the present invention is manufactured by conventional spin chuck methods. However, the spin chuck is initially treated to produce an etched surface having low profile depressions and protuberances, prior to formation of the reflector. The etching may take place chemically, utilizing a laser, by coining, and by way of other suitable processes. In most cases, the depth of etch on the spin chuck is less than 0.05 mm.

The reflector of the present invention includes a body, which may be a metallic body, that has an endless portion forming an endless outer surface, as well as an endless inner surface. The endless inner surface serves as the reflector for an illumination source such as a lamp. The body possesses an opening which communicates with the endless inner surface to permit light to escape from the cavity of the body for projection on a surface adjacent the reflector. The endless inner surface possesses a relatively fine pattern of depressions and protuberances derived from the etched surface of the spin chuck. In this way, the endless inner surface of the reflector may be easily removed from the spin chuck and is capable of scattering light. The problem is particularly vexing when the body forming the reflector is curved in cross-sectional configuration.

In most cases, the body forming the reflector is constructed of metallic material. However, other materials, which are capable of being bent against the spin chuck, may be employed. In any case, the relatively fine pattern of depressions and protuberances on the inner surface of the body are derived from the etched surface of the spin chuck, where the depth of etch ranges between 0.005 and 0.05 mm. In certain cases, the depth of etch on the spin chuck may range between 0.007 and 0.04 mm.

The light reflector of the present invention may also be formed such that the endless inner surface includes a first portion and an adjacent second portion. The adjacent second portion would lie next to the opening of the body and the relatively fine pattern of depressions and protuberances, derived from the etched surface of the spin chuck, would only be imparted to the second portion of the endless inner surface. It has been found that this construction produces reflected light from a source described as a "glow", due to the scattering of light from the second portion of the endless inner surface of the body. The relatively smooth first portion of the endless surface does not interfere with this result.

The present invention may also be deemed to include a process for manufacturing a reflector for an illumination source which utilizes a spin chuck having an etched surface. The process includes etching a pattern on the spin chuck surface through chemical means, by utilizing a laser, by coining, and through other like methods. The body or sheet of material is pressed against the spin chuck surface which is rotated. The pressing causes the spin chuck surface to deform the body in conformance with the shape and surface characteristics of the spin chuck surface. The result is the production of a relatively fine pattern of depressions and ridges on an inner surface of the body, derived from the etched pattern on the spin chuck surface. A further step would be the removal of the formed body from the spin chuck without impediment due to the spin chuck surface.

It may be apparent that a novel and useful lighting reflector has been described.

It is therefore an object of the present invention to provide a light reflector manufactured using a spin chuck having an etched surface to produce a fine pattern of protuberances and depressions on a reflective surface of the reflector to scatter light.

Another object of the present invention is to provide a light scattering reflector that is easily manufactured in large quantities.

A further object of the present invention is to provide a light scattering reflector employed with an illumination source that produces the reflection that is pleasing to view.

Another object of the present invention is to provide a reflector which scatters light from an illumination source and utilizes a spin chuck, a surface of which has been etched to certain tolerances.

A further object of the present invention is to provide a reflector which is capable of scattering light emanating from an illumination source that is formed over a spin chuck having a chemically etched surface.

A further object of the present invention is to provide a reflector which scatters light from an illumination source that possesses a curvilinear configuration and is easily removed from the spin chuck after formation.

The invention possess other objects and advantages especially as concerns particular characteristics and features thereof which will become apparent as the specification continues.

Figure 1:
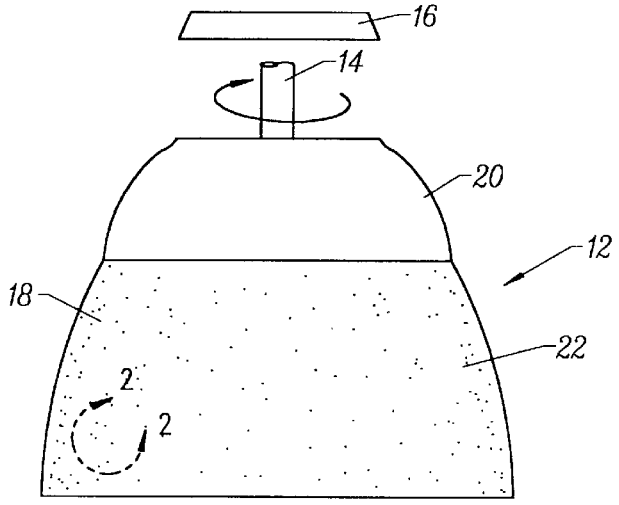
FIG. 1 is a side elevational view of a spin chuck utilized in the present invention.

For a better understanding of the invention reference is made to the following detailed description of the invention which should be taken in conjunction with the prior described drawings.

DETAILED DESCRIPTION OF THE PREFERRED EMBODIMENTS OF THE INVENTION

Various aspects of the present invention will evolve from the following detailed description, which should be taken in conjunction with the prior referenced drawings.

The article invention as a whole is depicted in the drawings by reference character 10, FIGS. 4–7. Reflector 10 is formed by a process which is also deemed to be part of the present invention.

Figure 2:
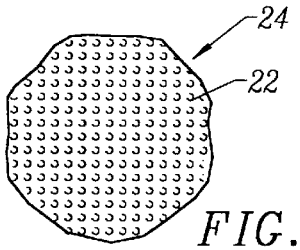
FIG. 2 is a magnified view taken along line 2—2 of FIG. 1.

Referring to FIG. 1, it may be observed that reflector 10 is manufactured using a spin chuck 12. Spin chuck 12 includes a rotating shaft 14 and a retainer 16. Spin chuck 12 is formed of a hardened material, such as metal, and possesses an outer surface 18. In the particular embodiment shown in the present invention, outer surface 18 includes a first portion 20 of relatively smooth surface characteristics and etched portion 22. Etch portion 22 of surface 18 may be etched by any known process such as chemical etching, laser etching, coining, and the like. In the preferred embodiment, etched surface 22 may be chemically etched to produce an etched surface which possesses a depth of etch ranging between 0.005 mm to 0.05 mm. Preferably the depth of etch ranges between 0.007 and 0.04 mm. Reference is made to U.S. Pat. No. 4,321,105, which is incorporated by reference in whole hereto. Such patent describes a typical method of producing chemically etched designs on surfaces, and may be employed herein to produce the etched surface on spin chuck 12 and second portion 22 of surface 18. FIG. 2 shows a magnified view of etched portion 22 of surface 18. Generally, etched surface 22 includes a plurality of protuberances 24 in a particular pattern. Ideally, protuberances 24 are free of sharp edges which may create galling or sticking problems with respect to reflector 10, which will be described hereinafter.

Figure 3:
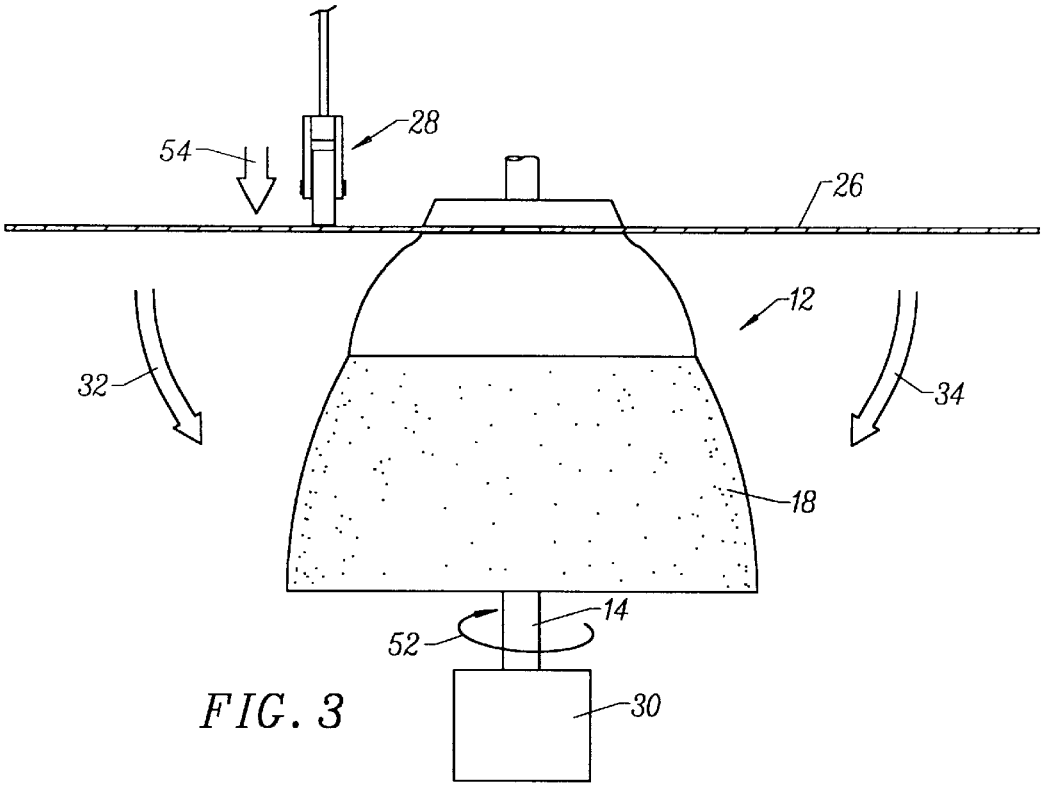
FIG. 3 is a side elevational view showing the forming of a reflector using the spin chuck of FIG. 1.
Figure 4:
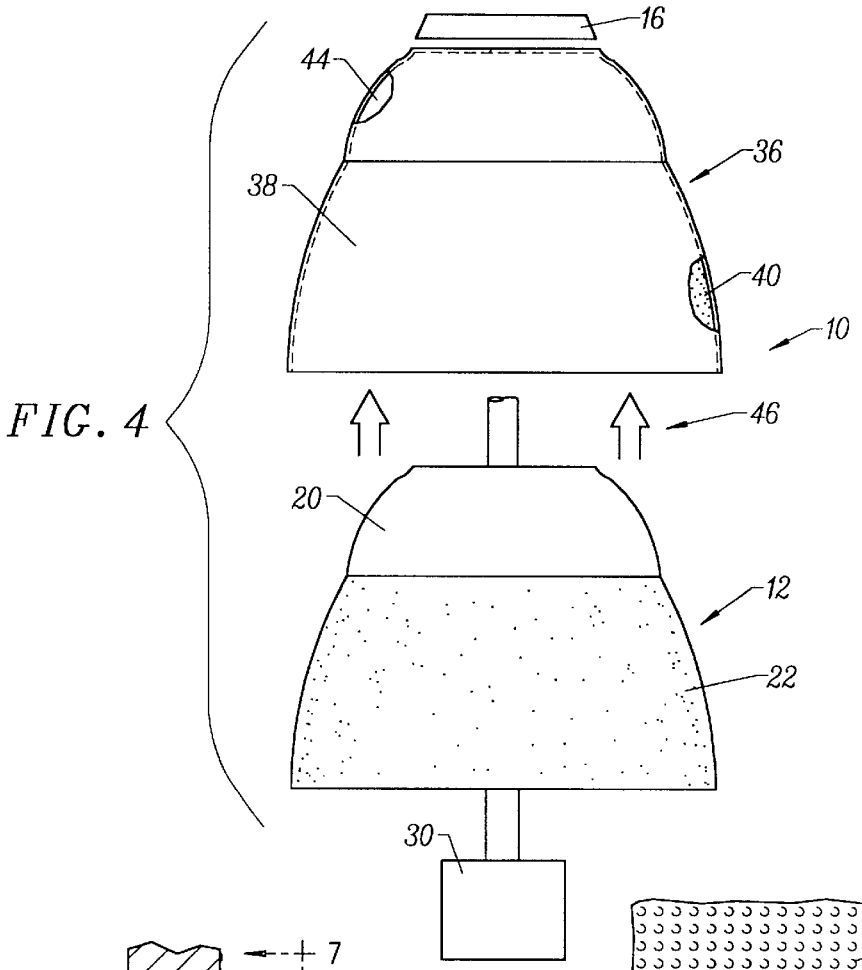
FIG. 4 is a side elevational view showing the removal of a formed reflector from the spin chuck of FIG. 1.

Turning to FIG. 3, it may be observed that a sheet of material 26, typically of a metallic material, is pressed against spin chuck 12 by a wheel 28 in a known manner. Motor 30 and shaft 14 rotates spin chuck as described in the prior art. Directional arrows 32 and 34 indicate the movement of portions of sheet of material 12 along side 18 of spin chuck 12. At this point, sheet of material 26 forms a body 36 depicted in FIG. 4. Body 36 is shown as a continuous curvilinear structure having an outer surface 38 and an inner surface 40. It should be realized that the etched surface 22 of spin chuck 12 has transferred a relatively fine pattern of protuberances and depressions 40 to inner surface 42 of body 12. It may also be apparent that in body 36, outer surface 38 and inner surface 42 are endless surfaces. That is to say, the relatively fine pattern of depressions and protuberances 40 found on inner surface 42 of body 36 are derived from the etched surface 22 of spin chuck 12. By the same manner, relatively smooth surface 20 of spin chuck 12 produces a relatively smooth inner portion 44 on inner surface 42 of body 36. Such fine pattern 40 permits easy removal of body 36 from spin chuck 12, indicated by directional arrows 46.

Figure 7:
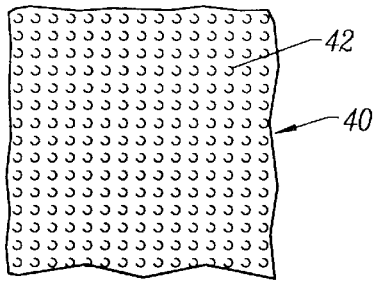
FIG. 7 is a magnified view taken along line 7—7 of FIG. 6.
Figure 6:
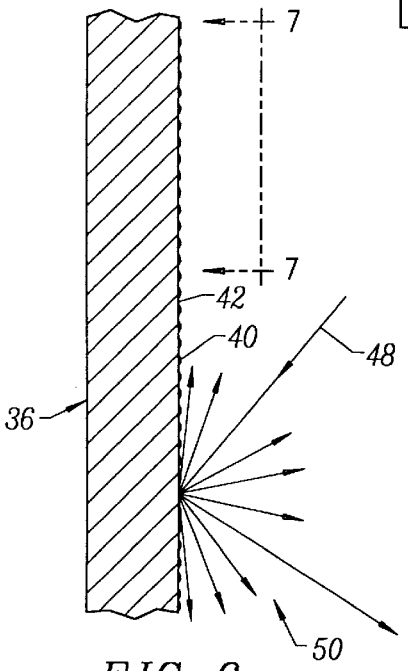
FIG. 6 is a sectional view of the reflector of FIG. 5 depicting the scattering of light therefrom.
Figure 5:
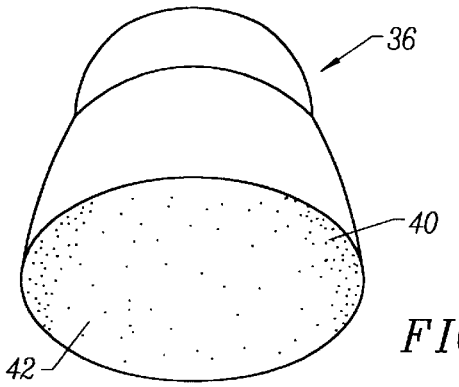
FIG. 5 is a bottom, side, isometric view of the reflector of FIG. 4.

Turning to FIGS. 6 and 7, it may be observed that an incident ray of light 48 from a source (not shown) is scattered, indicated by multiplicity of reflected rays 50. Such visual effect is referred to as "glow", and is deemed to be very desirable in the lighting field. FIG. 7 shows the regularity of the multiplicity of depressions and protuberances forming the fine pattern 40 on surface 42 of body 36. The multiplicity of rays 50, FIG. 6, also indicate that surface 42 of body 36 produces a reflection of light from incident ray 48 which lacks the harshness or brightness found in peened or sandblasted surfaces of the prior art.

In operation, reflector 10 is formed from a body 36 includes a contiguous or endless outer surface 38 and an endless or contiguous inner surface 42. Inner surface 42 is also constructed with a pattern of depressions and protuberances 40 which are capable of scattering light from incident ray 48. The pattern 40 on inner surface 42 of body 36 derives from the etched portion 22 of spin chuck 12 prior described. Reflector 10 is formed by etching pattern 22 on spin chuck 12 and rotating the same according to directional arrow 52, FIG. 3. Body or sheet of material 26 is pressed against rotating spin chuck 12 by wheel 12 according to force arrow 54. Thus, inner surface 42 of body 36 is formed, conformed to the outer surface 18 of spin chuck 12. The relatively fine pattern of depressions and ridges 40 on inner surface 42 of body 12, derived from surface 22 of spin chuck 12, produces reflector 10 which scatters light from a source and is easily removed from spin chuck 12 without galling or sticking, a common deficiency found in the prior art.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A reflector for an illumination source manufactured by a spin chuck having a etched surface, comprising:

a. a body having a endless portion forming an endless outer surface and an endless inner surface, said body including an opening communicating with said endless inner surface, said endless inner surface further including a relatively fine pattern of depressions and protuberances derived from the etched surface of the spin chuck, to permit release of said body from the spin chuck and to scatter light from the illumination source.

2. The reflector of claim 1 in which said body is curved in a cross-sectional configuration.

3. The reflector of claim 1 in which said body is constructed of metallic material.

4. The reflector of claim 1 in which said relatively fine pattern of depressions and protuberances on said inner surface are derived from the etched surface of the spin chuck having a depth of etch ranging between 0.005 millimeters to 0.05 millimeters.

5. The reflector of claim 1 in which said relatively fine pattern of depressions and protuberances on said inner surface are derived from the etched surface of the spin chuck having a depth of etch ranging between 0.007 and 0.04 millimeters.

6. The reflector of claim 1 in which said endless inner surface includes a first portion and an adjacent second portion lying next to said opening, said relatively fine pattern of depressions and protuberances derived from the etched surface of the spin chuck positioned on said second portion of said endless inner surface.

7. The reflector of claim 6 in which said relatively fine pattern of depressions and protuberances are derived from the etched surface of the spin chuck having a depth of etch ranging between 0.005 millimeters to 0.05 millimeters.

8. The reflector of claim 6 in which said relatively fine pattern of depressions and protuberances are derived from the etched surface of the spin chuck having a depth of etch ranging between 0.007 and 0.04 millimeters.

9. The reflector of claim 1 in which said fine pattern of depressions, and protuberances derived the etched surface of the spin chuck comprises a chemically etched surface of the spin chuck.

10. A process for manufacturing a reflector for an illumination source utilizing a spin chuck having a surface comprising:

a. etching a pattern on the spin chuck surface;

b. rotating said spin chuck surface; and c. pressing a body of material against said rotating etched spin chuck surface to deform said body to conform to said etched spin chuck surface in order to produce a relatively fine pattern of depressions and ridges on a surface of said body derived said etched pattern on the spin chuck surface.

11. The process of claim 10 in which said surface of said body possessing said relatively fine pattern of depressions and ridges, is an endless surface.

12. The process of claim 11 in which said endless surface of said body is curved in a cross-sectional configuration.

13. The process of claim 10 in which said pattern chemically etched on the surface of said spin chuck possesses a depth of etch ranging between 0.005 and 0.05 millimeters.

14. The process of claim 10 in which said pattern etched on the surface of said spin chuck possesses a depth of etch ranging between 0.007 and 0.04 millimeters.

15. The process of claim 12 in which said body is constructed of metallic material.

16. The process of claim 10 in which said step of etching a pattern on the spin chuck surface comprises the step of chemically etching a pattern on the spin chuck surface.

17. The process of claim 10 which includes the additional step of removing said body, conforming to said spin chuck surface, from said spin chuck surface.

* * * * *